US005398629A

United States Patent [19]

Wasenius

[11] Patent Number: 5,398,629

[45] Date of Patent: Mar. 21, 1995

[54] TRANSPORTATION OF OIL

[75] Inventor: Reidar Wasenius, Moss, Norway

[73] Assignee: Den Norske Stats Oljeselskap AS, Norway

[21] Appl. No.: 90,022

[22] PCT Filed: Jan. 17, 1992

[86] PCT No.: PCT/NO92/00007

§ 371 Date: Nov. 3, 1993

§ 102(e) Date: Nov. 3, 1993

[87] PCT Pub. No.: WO92/12893

PCT Pub. Date: Aug. 6, 1992

[30] Foreign Application Priority Data

Jan. 17, 1991 [NO] Norway ..... 910189
Apr. 12, 1991 [NO] Norway ..... 911453

[51] Int. Cl.[6] ..... B63B 25/12
[52] U.S. Cl. ..... 114/74 R; 114/211
[58] Field of Search ..... 114/74 R, 74 A, 211; 141/1, 11, 4, 63; 137/571, 572, 587, 627, 593, 1, 3

[56] References Cited

U.S. PATENT DOCUMENTS

| | | | |
|---|---|---|---|
| 2,049,987 | 8/1936 | Willenborg | 114/74 R |
| 4,144,829 | 3/1979 | Conway | 114/74 R |
| 4,233,922 | 11/1980 | Conway | 114/74 R |
| 4,292,909 | 10/1981 | Conway | 114/74 R |
| 4,446,804 | 5/1984 | Kristiansen | 114/74 R |
| 5,054,526 | 10/1991 | Perkins | 114/74 R X |

FOREIGN PATENT DOCUMENTS

| | | | |
|---|---|---|---|
| 0011589 | 1/1977 | Japan | 114/74 R |
| 0032586 | 3/1978 | Japan | 114/74 R |
| 8104095 | 1/1983 | Netherlands | 114/74 R |
| 0444549 | 4/1986 | Sweden . | |
| 0766955 | 10/1980 | U.S.S.R. | 114/74 R |
| 9112168 | 8/1991 | WIPO | 114/74 R |
| 9220571 | 11/1992 | WIPO | 114/74 R |

*Primary Examiner*—Sherman Basinger
*Attorney, Agent, or Firm*—Andrus, Sceales, Starke & Sawall

[57] ABSTRACT

The invention relates to a method for loading and discharging tanks (1) for transporting oil, a method for transporting oil in tankers (1) and a pipe and valve system (6, 7, 8) in a tanker (1) for performing the method. According to the invention, gassing of hydrocarbon containing gas during loading and unloading is reduced by loading or unloading the cargo tanks (2) while the oil is maintained in contact with a generally saturated HC gas. This is done by saving the HC gas which is developed during loading or unloading, this gas later being used in further loading and unloading. This is made possible by a pipe and valve system (6, 7, 8) according to the invention. In accordance with one embodiment of the invention, the tanks are filled completely so that the oil is present in tank hatches (10) and risers (11) located at the top of the tanks (2). This results in that the gas volume above the cargo before a possible grounding is approximately equal to zero and, consequently, the necessary underpressure is obtained above the cargo for establishing a hydrostatic balance at the bottom of the tanker (1) with a minimum spill of a cargo.

20 Claims, 9 Drawing Sheets

TRANSPORTATION OF OIL

FIELD OF INVENTION

The present invention relates to a method for loading and discharging of tankers for transportation of crude mineral oil/petroleum products, in the following referred to as oil, a method for transportation of oil in tankers, as well as a pipe and valve arrangement on tankers for application of said methods.

PRIOR ART

Transportation of oil with tankers consists mainly of four operations; loading of oil into the cargo tanks at the supply location, transportation of oil from the supply location to the destination, discharging of oil from the cargo tanks of the tanker at the destination and the ballast trip, i.e. a trip in which the tanker is not transporting oil, from the destination back to the supply location.

Today's methods for loading and discharging of oil may result in losses of oil and substantial strains on the surroundings resulting from the fact that some of the oil transforms into gas which in turn is pushed out to the atmosphere. Upon starting the loading of oil into the cargo tanks of the tanker, the oil is supplied under high pressure to tanks with lower pressure. These tanks are prior to loading typically occupied by gases with a low pressure and low concentrations of hydrocarbons, in the following referred to as HC, and the oil will therefore start developing gas to reach a combination of pressure and HC-concentration giving saturation at the present temperature of the oil.

Upon discharging of oil from the cargo tanks the oil will leave the tanks by means of pumps via pipes at the bottom of the tanks. This results in movements in the oil, and will further lead to that the ullage space increases and that the pressure above the oil decreases. Consequently, the oil will release HC gas until the saturation pressure is reached. When the pressure drops below a certain value, valves at the top of the tank will open and inert gas or air is supplied. After this there exists a low pressure gas mixture above the oil. This interaction between pressure drop, de-gassing of the oil and introduction of inert gas or air will continue throughout all of the discharging, and upon completion of the discharging, relatively great amounts of HC gas may have been released to the tank atmosphere. The actual amount will depend on the vapor characteristics of the oil and the saturation pressure of the oil gas at the present temperature.

De-gassing of oil may also represent a problem during the transportation trip. Because of a possible expansion of the oil during transportation, the cargo tanks are typically loaded up to 98% of the cargo capacity. During transportation the movements of the tanker will propagate to the oil. The continuing movements at the surface of the oil together with the pressure fluctuations in the ullage space filled with gas, results in that the oil constantly may release gases to the free air outside of the tanker resulting from the fact that the gas pressure is higher than the setting pressure of the pressure/vacuum valves typically arranged at the top of the tanks.

Great discharges of oil resulting from a possible grounding of the tanker may represent another problem during the transportation trip. Prior to the grounding of a fully loaded tanker the pressure at the inside of the tank bottom will be higher than the pressure from the outside; there exists a hydrostatic pressure difference. Upon grounding there is formed a rupture in the tanker bottom, resulting in that oil is leaking out of the tanker until the pressure at the inside of the bottom equals the pressure at the outside; a hydrostatic balance has been established at the bottom. This balance will be established when the surface of the oil has been reduced to a level corresponding to the hydrostatic pressure difference existing at the tanker bottom prior to the grounding plus the outer pressure reduction resulting from the fact that the draft of the tanker is reduced when oil is leaking out of the cargo tanks. If the gas-filled ullage space is communicating with the atmosphere, there will exist an approximate balance above the cargo surface when the hydrostatic balance is established at the bottom of the tanker, and maximum discharge of oil is obtained. The discharge of oil may however be reduced by utilizing the reduction of the liquid level in the tank to establish an underpressure between the surface of the liquid and the ceiling of the tank. The underpressure which may be established in this way is limited by the strength of the tank and the vapor characteristics of the oil. The expansion of the mixture of inert gas and HC gas above the cargo surface may be calculated from the state equation for ideal gases stating that the product of pressure and volume is constant. This is assumed to be approximately valid for said gas mixture. If the volume of- and the pressure in the ullage space is referred to as V and p, respectively, the volume change $\Delta V$ is $$\Delta V = V_1 - V_0 = (p_0/p_1)^* V_0 - V_0 = (p_0/p_1 - 1)^* V_0$$

Assuming that said underpressure method is utilized, one can see that the volume $\Delta V$ of the oil being pushed out of the tank will increase when the size of the gas volume $V_0$, which exists above the tank prior to the discharge, is increased. With cargo tank volumes of 50,000 $m^3$ and a loading degree of 98%, the volume $V_0$ is substantial.

BRIEF DESCRIPTION OF THE INVENTION

The purpose of the present invention is to solve the abovementioned problems in connection with loading, discharging and transportation of oil in tankers.

According to the invention the abovementioned disadvantages related to known methods for loading and discharging are avoided by loading or discharging the oil at the same time as the oil is kept in contact with a substantially saturated HC gas. This is achieved by storing the HC gas which is released during loading or discharging, with the purpose of subsequently using said HC gas upon further loading or discharging according to the invention. This is possible by means of a pipe and valve arrangement according to the invention.

According to one embodiment of the invention, the tanks are completely loaded such that the oil is filled up and into the tank hatches and risers at the top of the tank. In this way one achieves that the gas volume above the cargo prior to a possible grounding is approximately zero, which results in that the required underpressure above the cargo to achieve a hydrostatic balance is established at a minimum discharge of cargo.

Further characteristics of the invention are evident from the attached claims.

DESCRIPTION OF DRAWINGS

The FIGS. 1*a* and 1*b* illustrate a vertical and a horizontal section of the tanker, respectively.

Figure 4A:
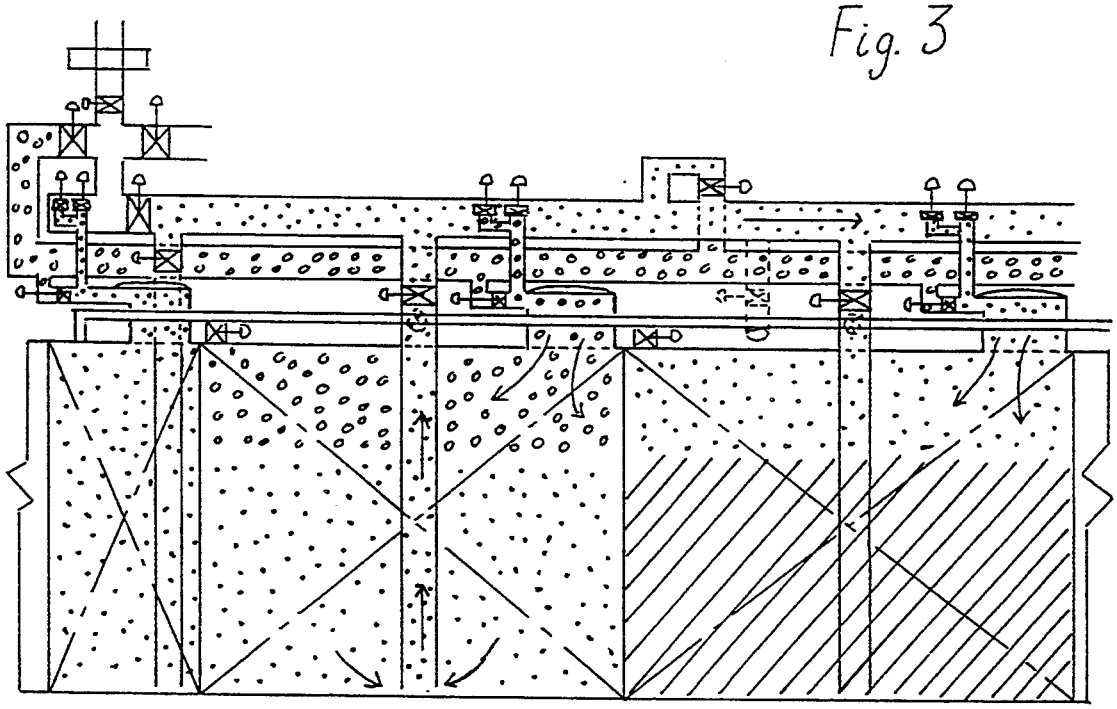
Figure 4B:
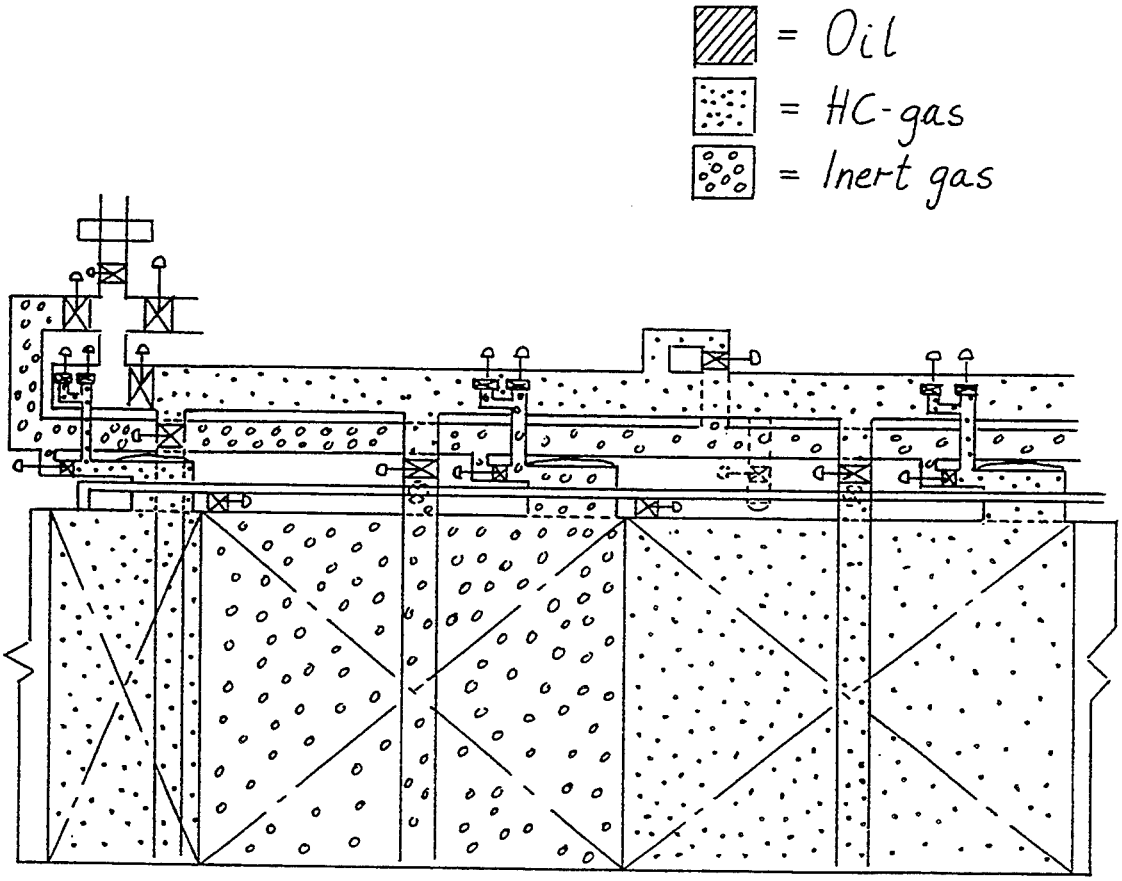

The FIGS. 4*a* and 4*b* give a schematic illustration of the contents in a part of the tanker at two different stages of discharging according to an embodiment of the invention.

Figure 5A:
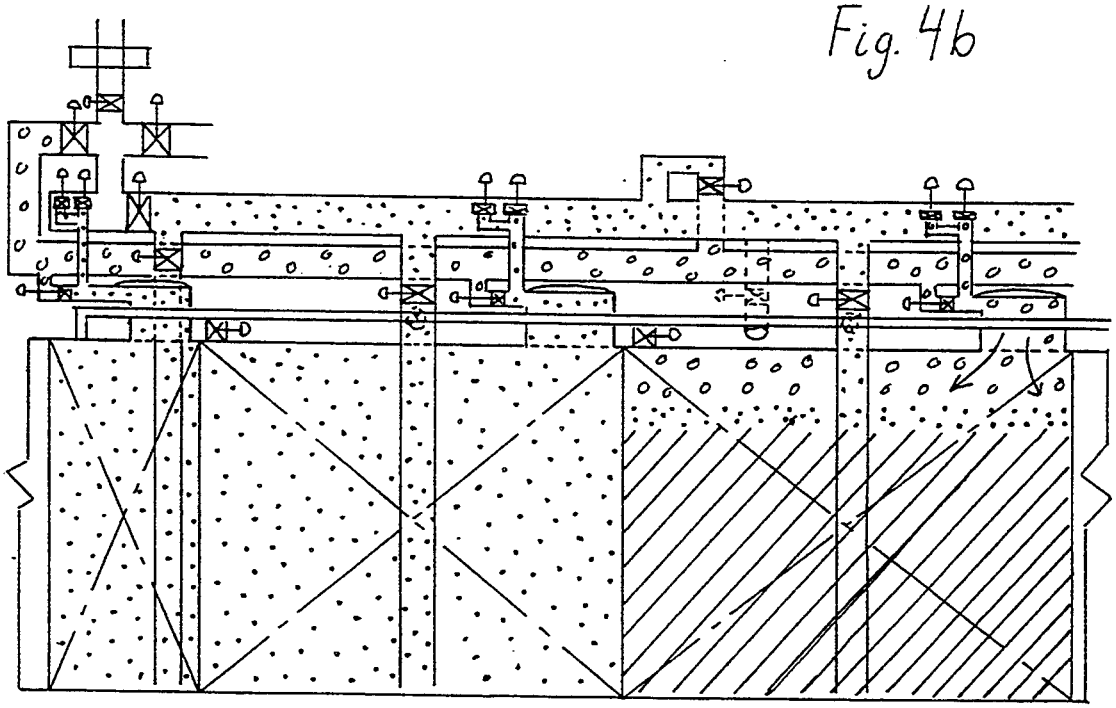
Figure 5B:
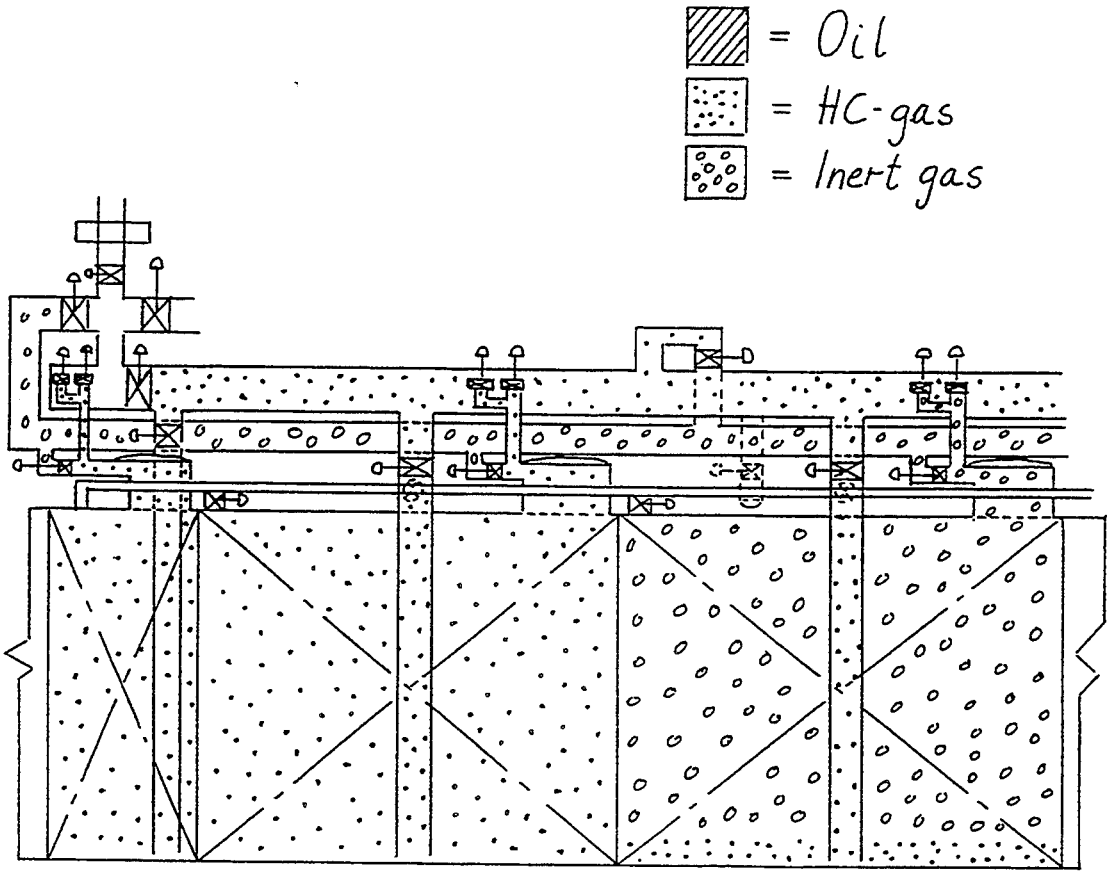

The FIGS. 5*a* and 5*b* give a schematic illustration of the contents in a part of the tanker at two different stages of discharging according to an embodiment of the invention.

Figure 6A:
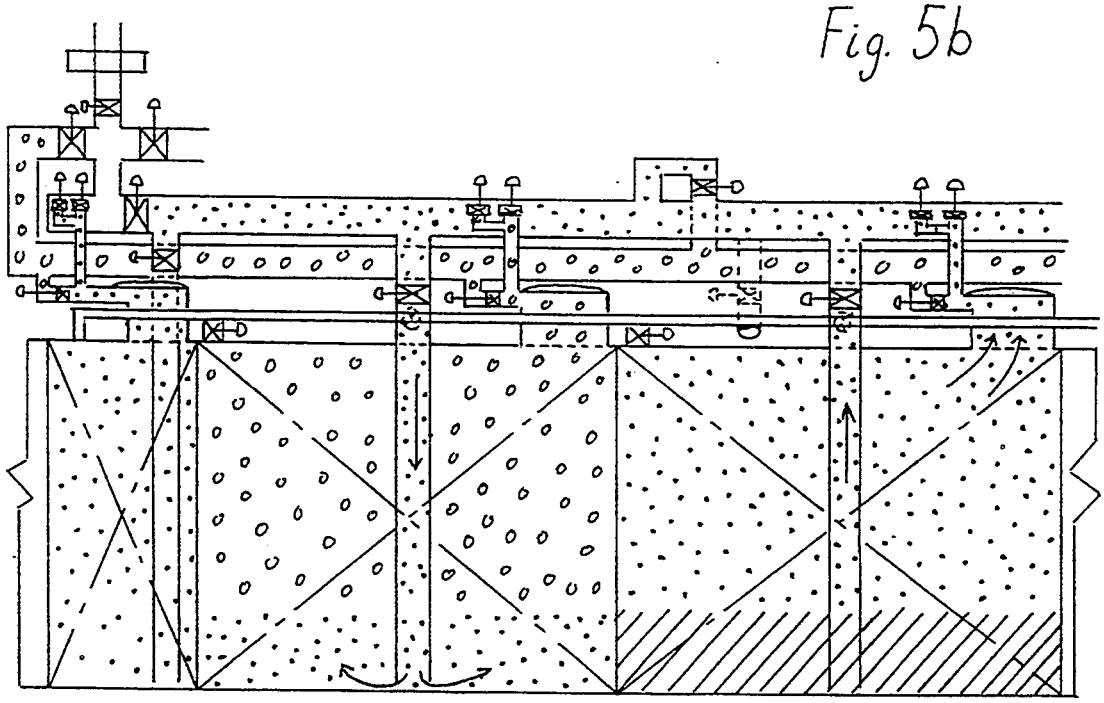
Figure 6B:
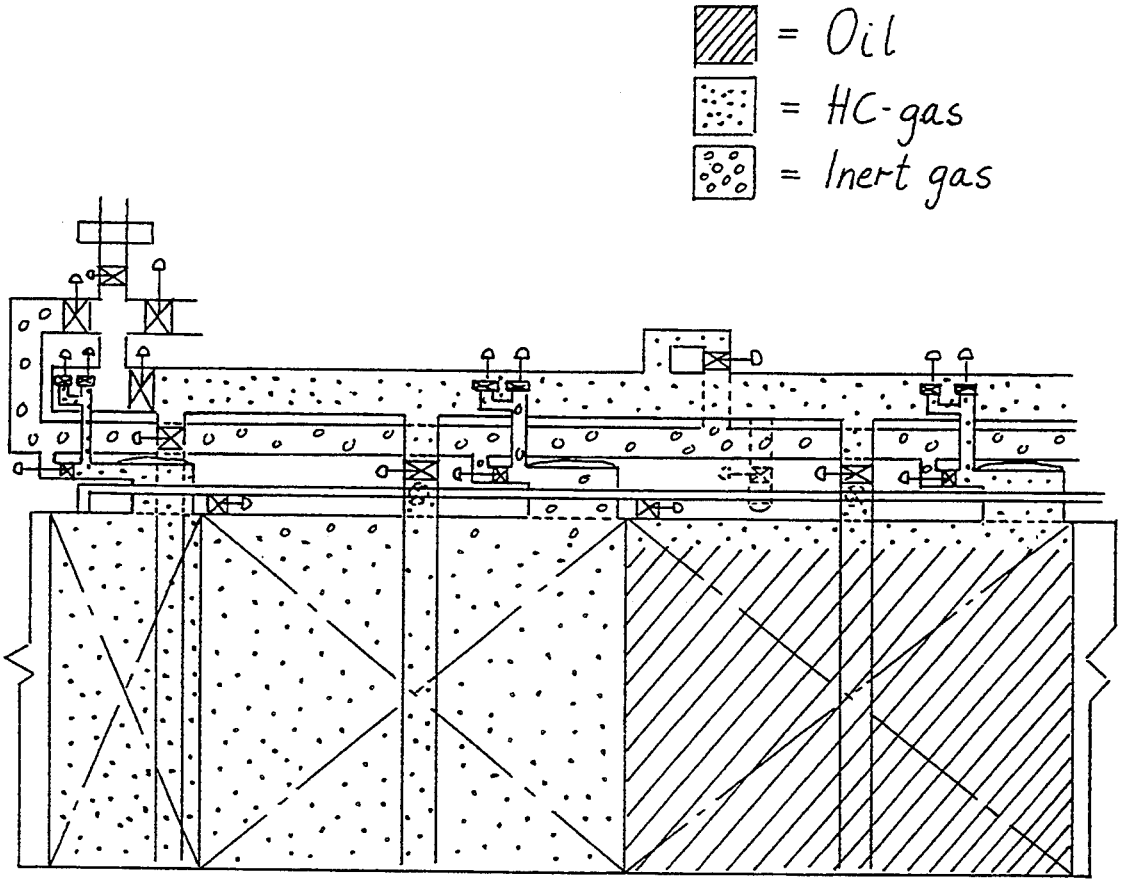

The FIGS. 6*a* and 6*b* give a schematic illustration of the contents in a part of the tanker at two different stages of loading according to an embodiment of the invention.

Figure 7A:
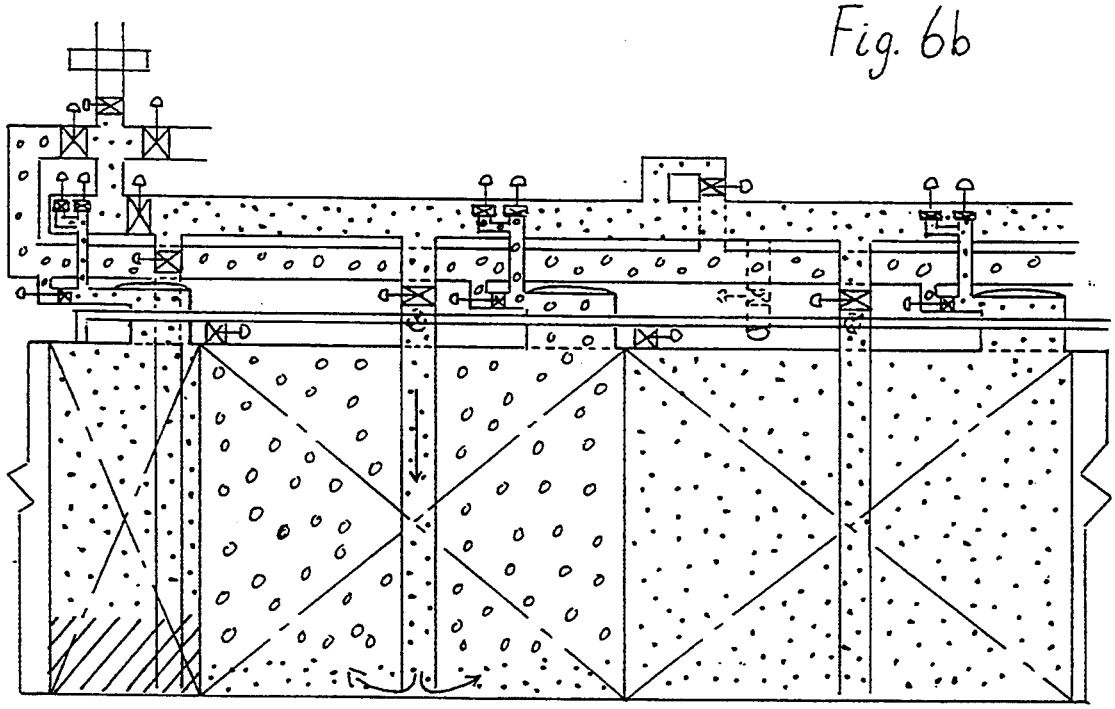
Figure 7B:
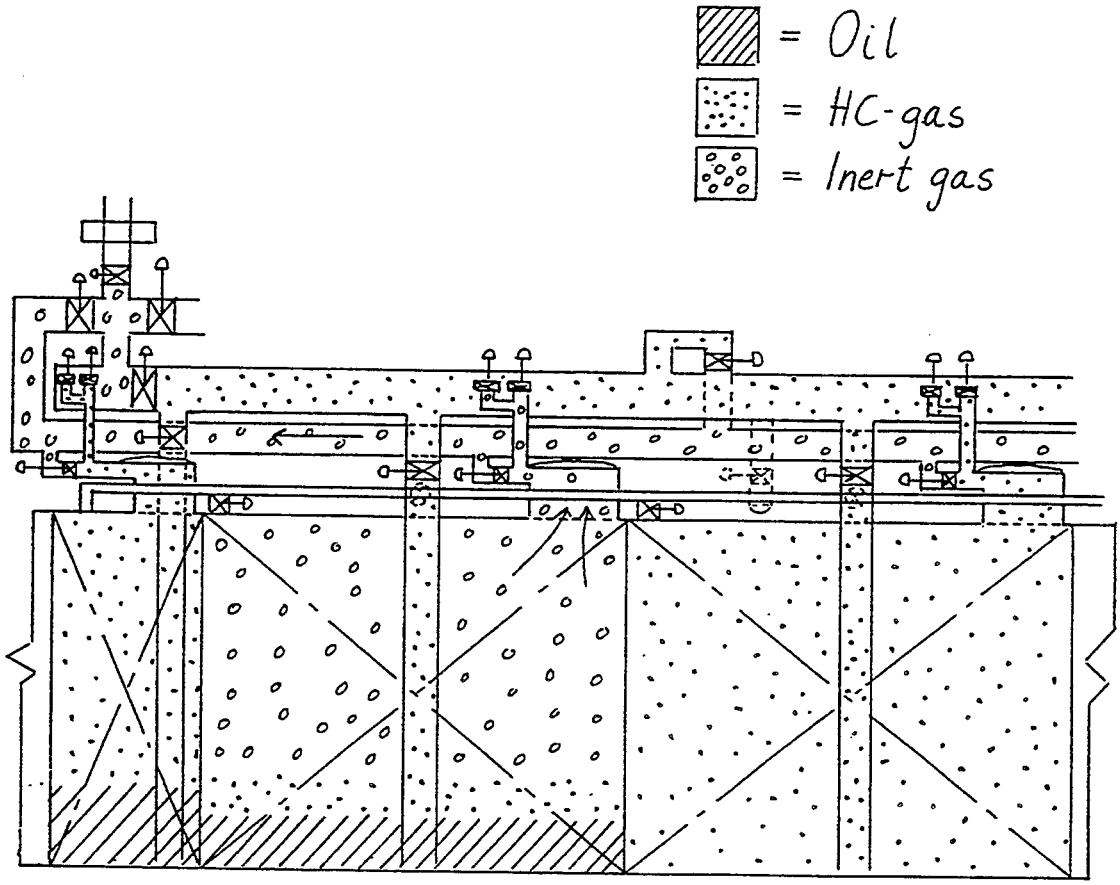
Figure 7C:
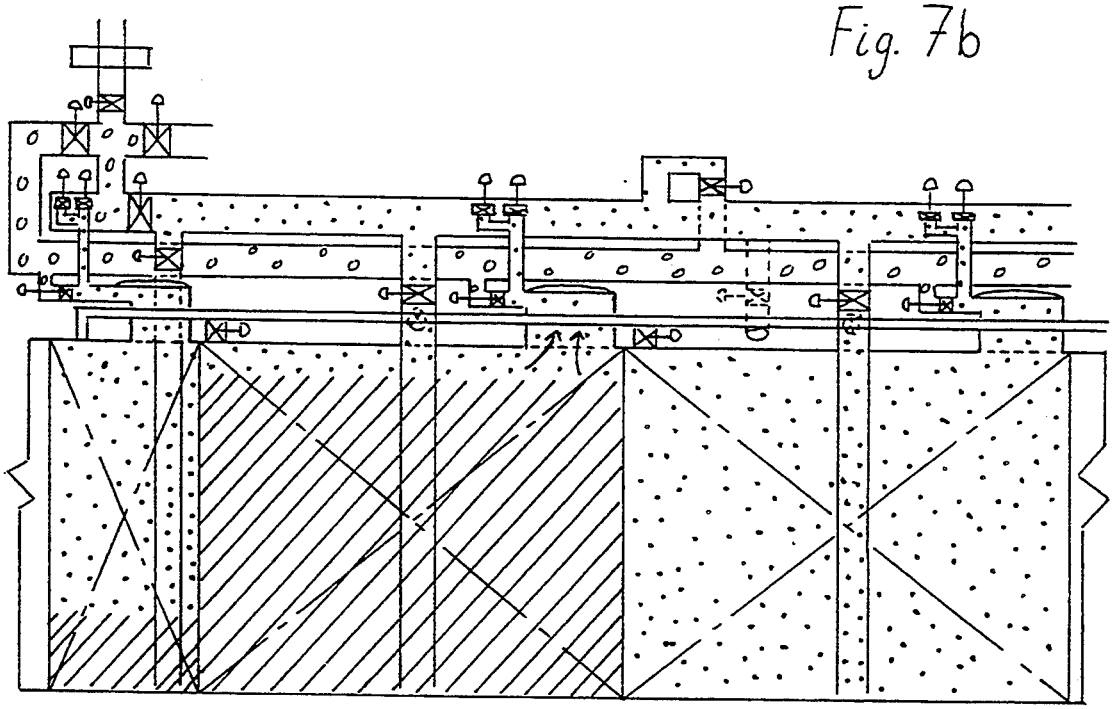

The FIGS. 7*a* and 7*c* give a schematic illustration of the contents in a part of the tanker at three different stages of discharging according to an embodiment of the invention.

Figure 1A:
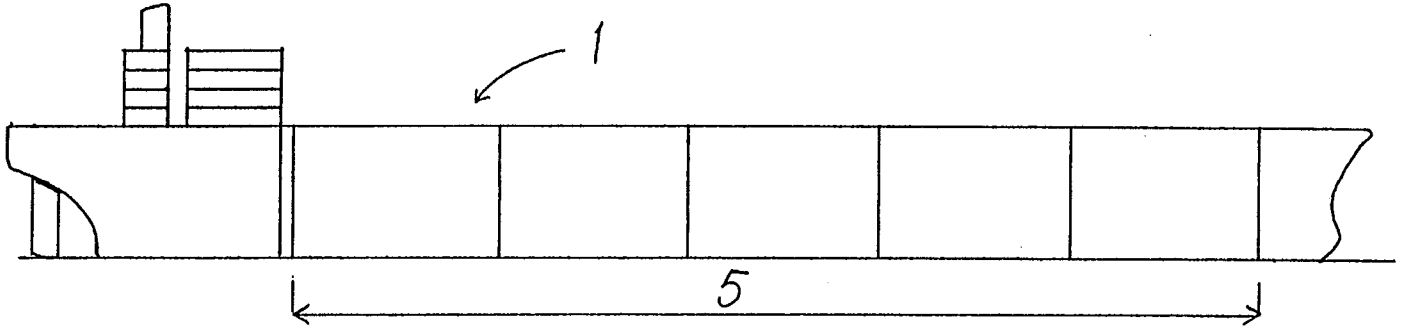
Figure 1B:
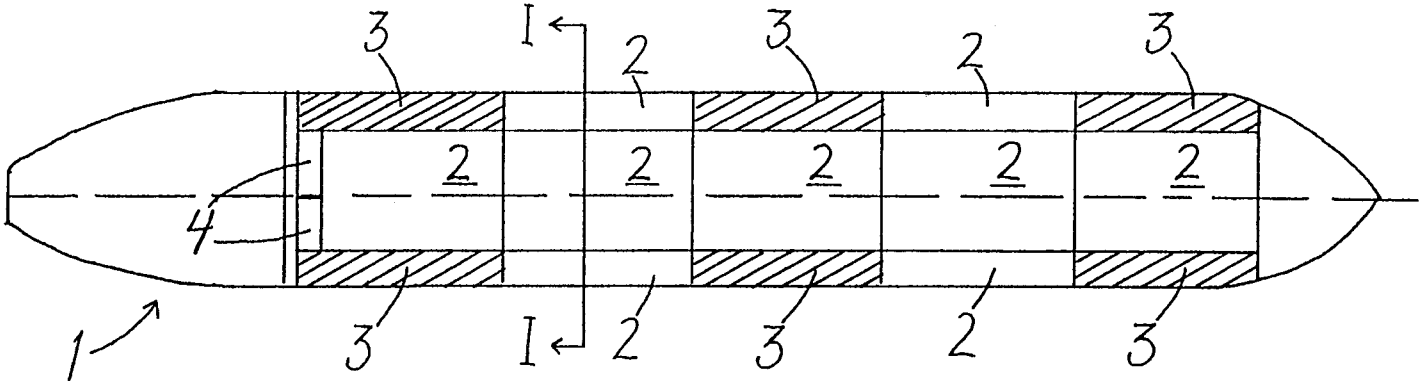
Figure 8:
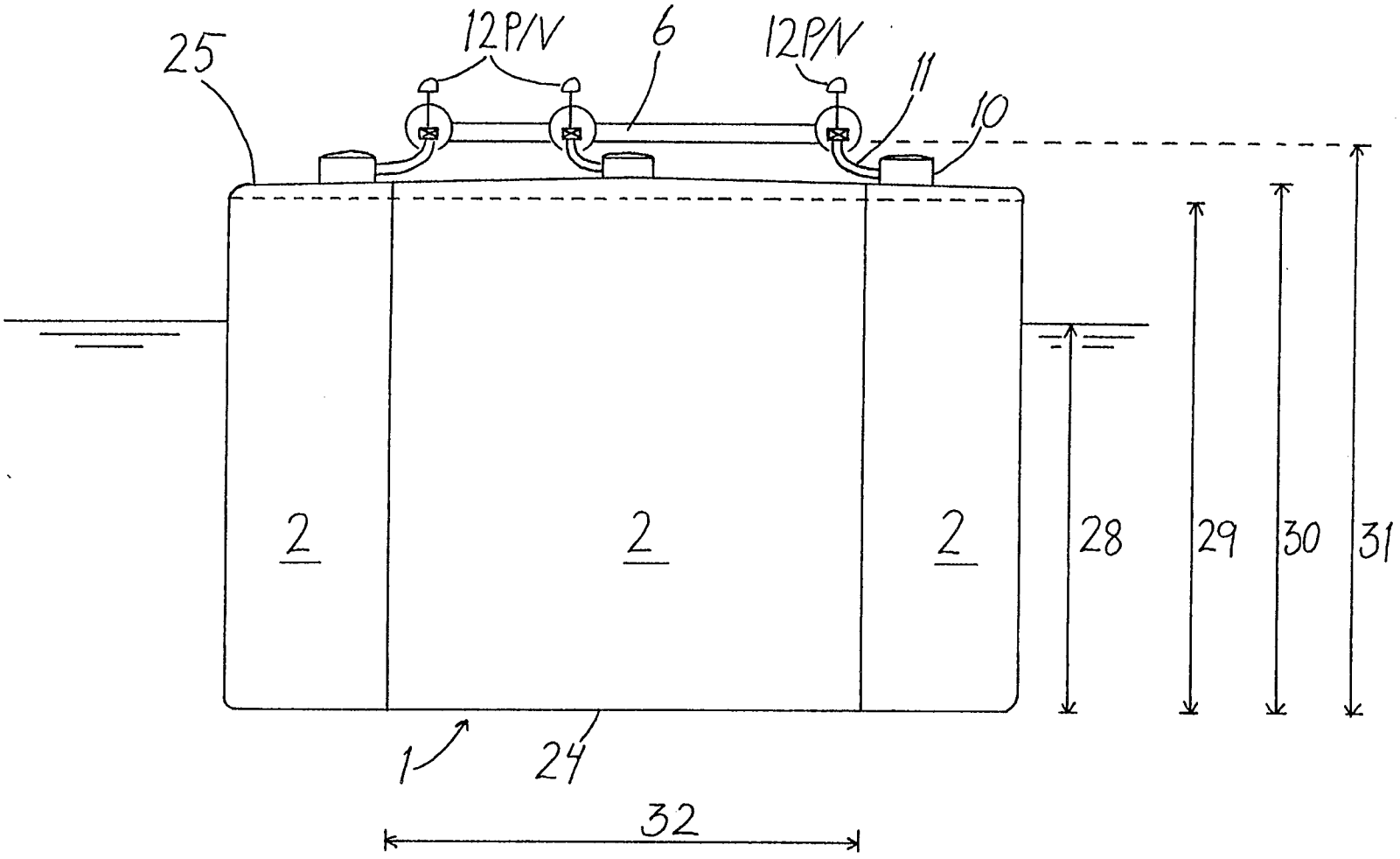

FIG. 8 is a vertical section of the tanker with a pipe and valve arrangement according to the invention along the line I—I in FIG. 1*b*.

Figure 9A:
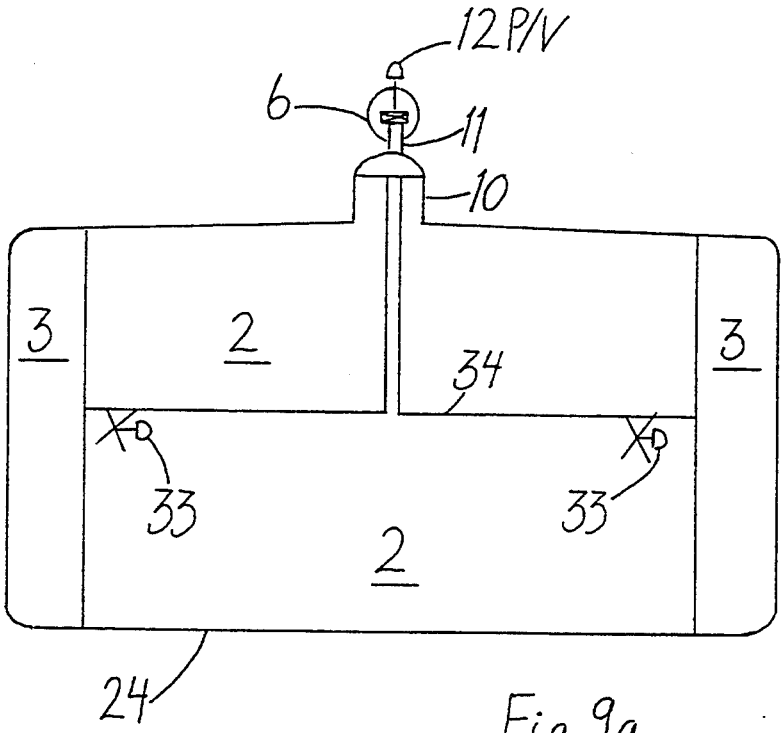
Figure 9B:
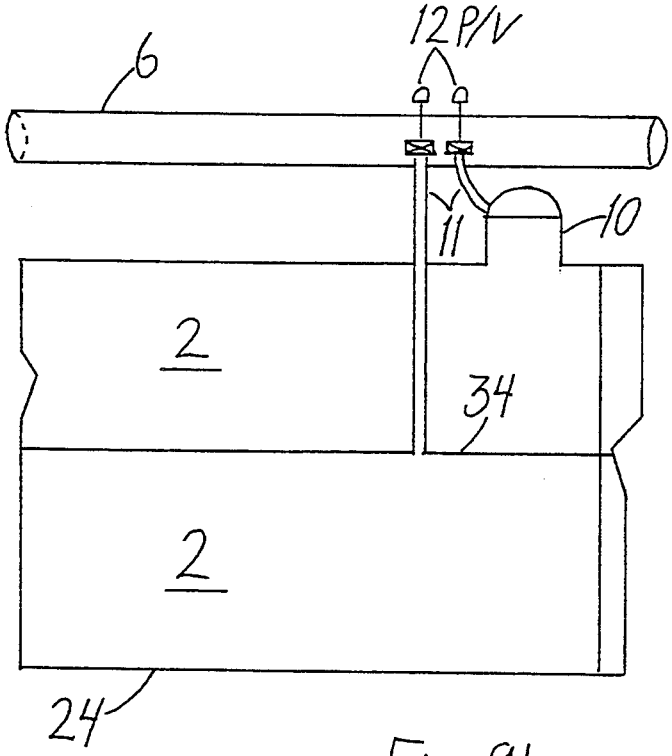

The FIGS. 9*a* and 9*b* illustrate a vertical section of parts of an alternative embodiment of the pipe and valve arrangement.

EXAMPLIFYING EMBODIMENTS OF THE INVENTION

FIG. 1*b* is a horizontal section of a tanker 1 with cargo tanks 2, ballast tanks 3 and slop/cargo tanks (S/C tanks) 4. The ballast tanks 3 are filled with ballast during the ballast trips, and are empty during the transportation trips. The S/C tanks 4 are carrying cargo during the transportation trips, and if a tank cleaning with water is carried out after the discharging, the S/C tanks 4 will contain a mixture of oil and water during the ballast trip. The length 5 illustrates the total length of the cargo section.

Figure 2:
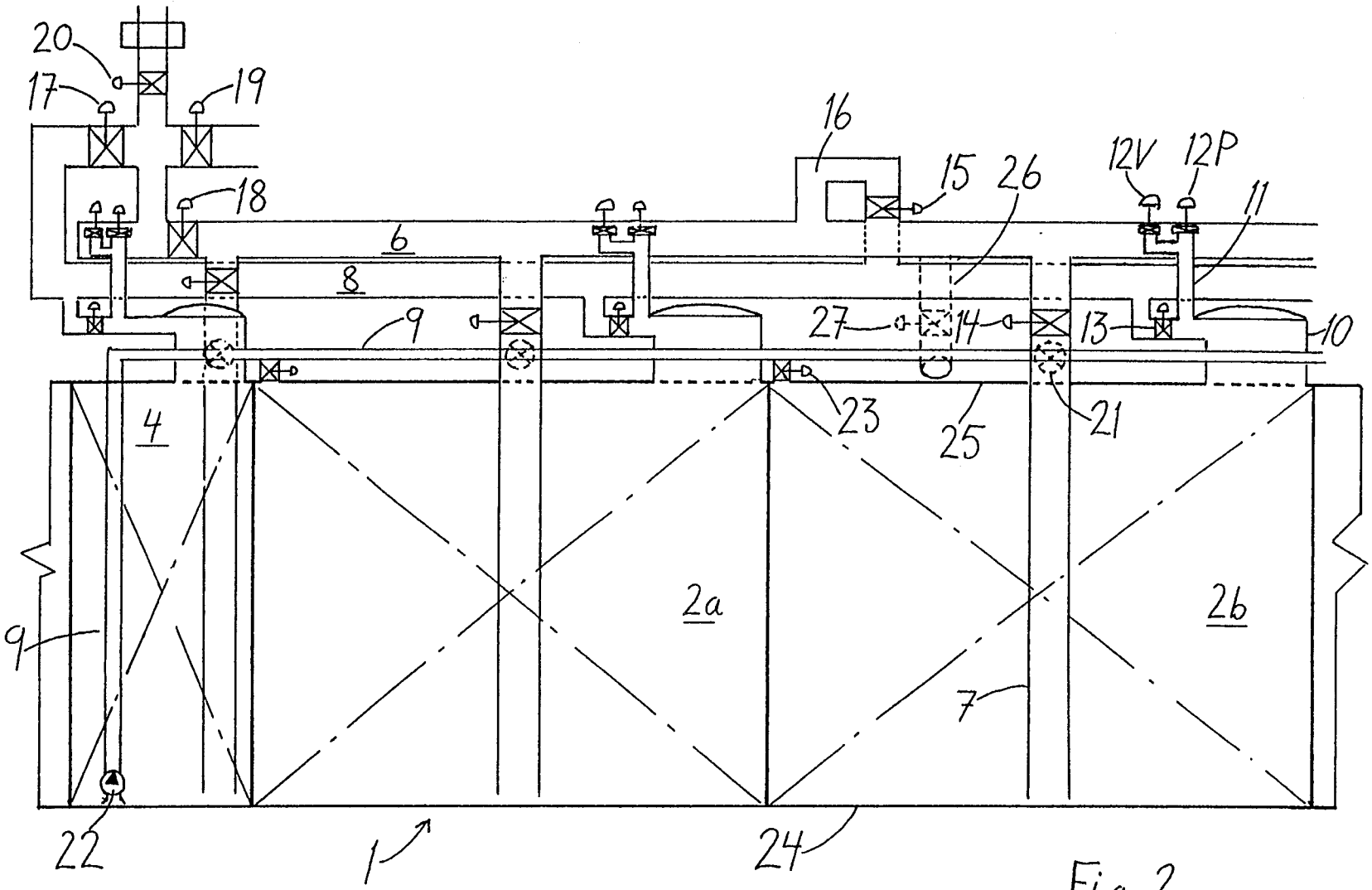
FIG. 2 gives a schematic illustration of a tanker pipe and valve arrangement according to the invention.

FIG. 2 illustrates a section of a part of a pipe and valve arrangement according to the invention which is arranged on top of the deck 25 of the tanker 1, and which comprises a header 6 which is connected to a conventional standard pipe arrangement 8 for inert gas via a pipe 16 with a valve 15. Depending on the presetting of the valves 15, gas may flow unconstrained between the header 6 and the pipe arrangement 8 for inert gas. The header 6 communicates with the cargo tanks 2*a*, 2*b* and slop tanks 4 through the pipe 7 with a valve 14, and it will be understood that when the valves 14 are in their open position the header 6 and the pipes 7 form an open connection between the cargo tanks 2*a*, 2*b* and the slop tanks 4.

The cargo tanks 2*a*, 2*b* and the slop tanks 4 each have their own tank hatch 10 communicating with the header 6 and the pipe arrangement 8 for inert gas through risers 11 with associated pressure/vacuum valves 12P, 12V and valve 13, respectively. The valves 12P, 12V may either be forcibly controlled to open or closed position, or they may be tuned such that they let gas flow into the tanks 2*a*, 2*b*, 4 through the valve 12V at a certain underpressure, and let the gas flow out from the tanks 2*a*, 2*b*, 4 through the valve 12P at a certain overpressure. Said forced control may be either manual or automatic.

The magnitude of said under- or overpressure will be limited by what loads the deck 25 is designed to withstand. The valve 13 may either be forcibly controlled to open or close, or it may be preset such that it is controlled by the pressure in the tanks 2*a*, 2*b*, 4 together with a sensor monitoring the concentration of HC gas in the tanks. In the latter case the valve will open when the pressure in the tank exceeds a preset value, preferably the same value as the opening pressure of the valves 12P, given that the concentration of HC gas is below a certain level. When the concentration of the HC gas exceeds this level the valve 13 will close. The valves 14, 15, 17 and 18 may be forcibly controlled to either open or closed position. If necessary the HC gas may be transported from the tanks 2*a*, 2*b*, 4 via valves and pipes 21 to a not shown recovery plant. The valves 19 and 20 may be forcibly controlled to either open or close position, and they will control the gas flow from the pipe and valve arrangement to the ballast tanks 3 and the atmosphere, respectively. Additional valves 23 forming a connection to a pipe arrangement 9, extending down into the S/C tanks 4, are arranged at the top of the tanks, and the pipe arrangement 9 is connected to a pump 22 in the S/C tanks 4 for transportation of oil from the S/C tanks 4 to the cargo tanks 2*a*, 2*b*.

The FIGS. 3–7 illustrate the contents in the pipe and valve arrangement and the tanks 2*a*, 2*b*, 4 in FIG. 2 at different stages of discharging and loading. For the purpose of simplicity these figures are not provided with reference numerals and will therefore have to be studied in connection with FIG. 2 in the rest of the specification.

FIG. 8 is a vertical section of the tanker along the line I—I in FIG. 1. For the purpose of simplicity only parts of the pipe- and valve arrangement are included, and from the same reason the pressure/vacuum valves 12P, 12V are shown as one valve 12P/V. The three cargo tanks 2 each have their own hatch 10 at the top of the tanks. The figure also illustrates an embodiment of a pipe and valve arrangement according to the invention, in which the header comprises three parallel pipes transversely connected via connecting pipes. The risers 11 extend into the header 6, wherein the communication between the riser 11 and the header 6 is controlled by means of the valves 12P, 12V. The draft 28 of the tanker, loading level 29 according to known methods, tank height 30, loading level 31 according to the invention and the width 32 of the centre cargo tank 2 will be included in the Calculations below which demonstrate the advantages in connection with the reductions of discharges which are achieved according to an embodiment of the invention.

The FIGS. 9*a* and 9*b* illustrate parts of an alternative embodiment of the pipe and valve arrangement. In this case the cargo tanks 2 are provided with a known type of 'tween deck 34, and in this way the tanks are split forming two tanks. Each of the cargo tanks therefore have two risers 11 with associated pressure/vacuum valves 12P, 12V; one riser 11 extends from the hatch 10 and into the header 6, while the other riser 11 extends from the lower part of the tank 2 and into the header 6. The communication between the lower and the upper part of the tank 2 is controlled through the valves 33. For the purpose of simplicity ,only those parts being different from the embodiment illustrated in FIG. 2 are shown in the FIGS. 9*a* and 9*b*, and from the same reason the pressure/vacuum valves 12P, 12V are shown as only one valve 12P/V.

Throughout the rest of the specification letters a, b or c are attached to some of the reference numerals. These letters are referring to the tanks 2a, 2b and 4, respectively.

The method for discharging when the cargo tanks are carrying crude oil will normally involve the step of initially performing a tank cleaning by using the transported oil as detergent. This kind of tank cleaning, also referred to as crude oil washing, may be carried out for a set consisting of, for example, two cargo tanks per discharging, and it may be done as described in the following:

First, discharging of those S/C tanks 4 and cargo tanks 2a which are to be cleaned by means of oil will be initiated. Some of the cargo in the cargo tanks are removed, and in this way the tank cleaning may be started at the top of these tanks. The S/C tanks 4 are provided with not shown means for heating of the oil, and heated oil from the S/C tanks 4 is discharged via not shown flushing arrangements in the cargo tanks 2. The heating of the oil increases the cleaning effect. During the cleaning the tank atmosphere is saturated with HC gas in the cargo tanks 2 at the same time as the temperature of the oil in the S/C tanks 4 is maintained sufficiently high so that the gas atmosphere in these tanks has an overpressure compared to the outer atmospheric pressure. Throughout all of this process HC gas will be formed resulting from the cleaning of the tank by means of the oil at the same time as the volume of above the cargo surface in the tanks 2a, 4 is increasing. When the tank cleaning is completed, the cargo tanks 2a just cleaned and the S/C tanks 4 will no longer contain any oil, and these tanks will, together with the header 6, be filled with saturated HC gas with a marginal admixture of inert gas, as it is illustrated in FIG. 3.

Figure 3:
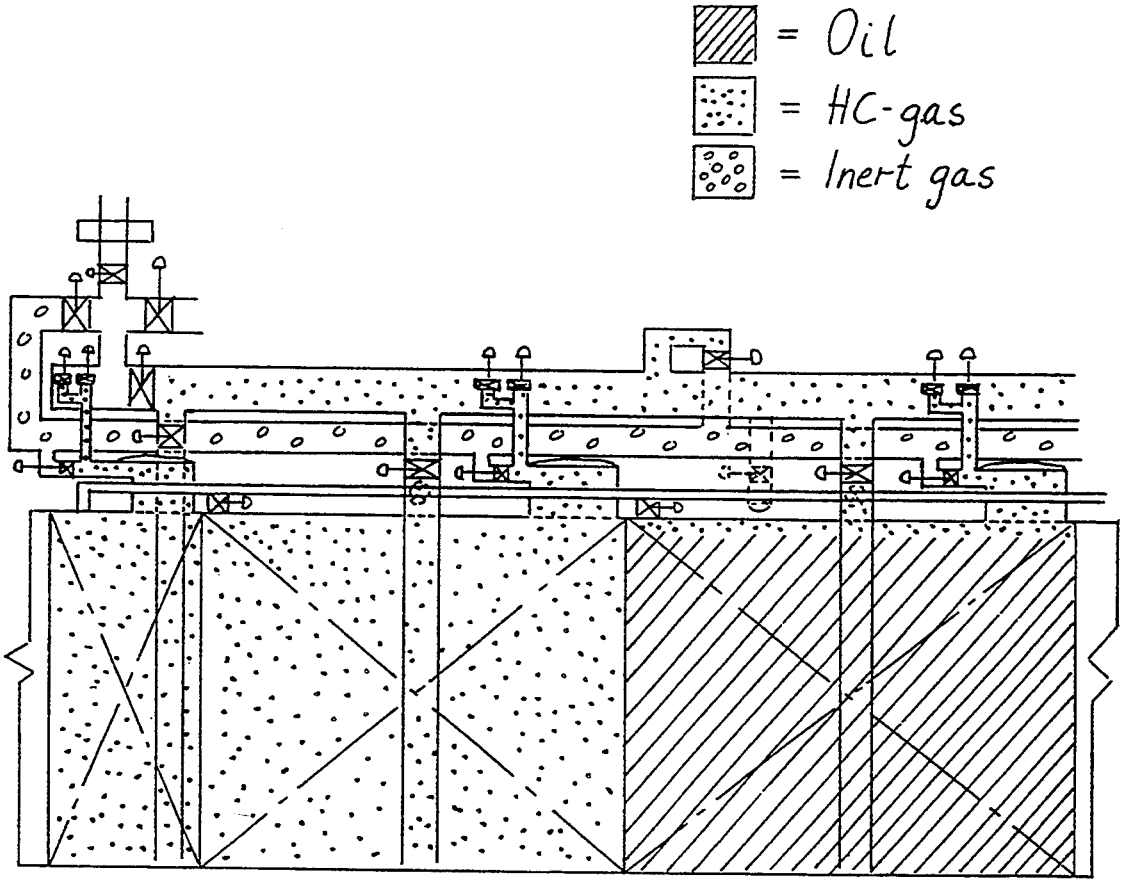
FIG. 3 gives a schematic illustration of the contents in a part of the tanker following a tank cleaning.

Referring to the tank picture existing after the cleaning of the tanks, see FIG. 3, a second set of tanks 2b is, according to the invention, discharged at the same time as saturated HC gas is carried in above the cargo in these tanks. The valves 14a are now open such that upon opening of the valves 12bP there will exist an open connection between the cargo tanks 2a and the cargo tanks 2b via the header 6. The valves 13a are open, and when the tanks 2b are discharged the inert gas supplied to the cargo tanks 2a from the inert gas arrangement (not shown) of the tanker via the pipe arrangement 8, the open valves 13a and the hatches 10a will push saturated HC gas to the increasing ullage space in the cargo tanks 2b via the pipes 7a and the header 6. The FIGS. 4a and 4b illustrate the situation at recently initiated and completed discharging, respectively, of the tanks 2b. Subsequently the remaining tank sets are discharged sequentially according to the method used when discharging the cargo tanks 2b. When all of the tanker is discharged, the tank set 2 which was discharged at the very end of the procedure and the S/C tanks 4 will be filled with saturated HC gas with a marginal admixture of inert gas, while the rest of the sets of cargo tanks 2 are filled with inert gas with a marginal admixture of HC gas.

Referring to the tank picture existing following the cleaning of the tanks, see FIG. 3, another preferred embodiment of the invention for discharging of oil will be explained. Assuming that the cargo tanks are loaded up to a level somewhat below 100% of the tank height, preferably 98%, as it is suggested in FIG. 3, there will prior to the discharging of the remaining cargo tanks exist a layer consisting of pure saturated HC gas directly above the cargo surface, and above this layer there will exist a non combustible mixture of HC gas and inert gas. Simultaneously with the discharging of the cargo tanks 2b, inert gas is carried in a controlled way from the inert gas arrangement (not shown) of the tanker and into the volume above the cargo surface via the pipe arrangement 8 for inert gas, the valves 13b, being forcibly controlled to opened position, and the hatches 10b such that the layer consisting of pure HC gas is directly above the cargo surface when the oil is guided out of the tanks 2b. During the discharging the cargo will therefore release no, or a minimum of, HC gas since the oil surface is kept in contact with the HC gas throughout the entire operation. The remaining set of cargo tanks are discharged in the same way as the tanks 2b, and upon completion of the discharging there will at the bottom of the cargo tanks initially not being cleaned exist a layer consisting of saturated HC gas, while the rest of the volume in these tanks 2b mainly consist of inert gas. The FIGS. 4a and 4b illustrate the situation at recently started- and completed discharging, respectively, of the tanks 2b. As later will be evident from the description of the method for loading, it may be appropriate to load the tanks 2 all the way up the valves 12P, 12V, i.e. the tanks 2 are loaded with a loading degree of approximately 100%. However, the same method for discharging may be used in this case, the only difference being that the valves initially are kept in the closed position until some of the cargo is discharged, i.e. to a level below these valves. Thus a de-gassing of oil will take place in the pipe 11b and hatches 10b before the valve 12aV is opened, and there is formed a layer consisting of saturated HC gas above the cargo. After this the valves 13b are opened, and the rest of the discharging are carried out as outlined above.

Referring to the tank picture existing after the completion of one of the abovementioned methods for discharging of the S/C tanks 4 and the cargo tanks 2, as it is illustrated in FIG. 4b or 5b, a method for loading the tanker 1 will be explained in more detail. The loading is started by first loading the tanks which was discharged at the end of the discharge procedure. Referring now to FIG. 4b and assuming that the tanks 2b was discharged at the end of the discharge procedure, the loading is started in parallel at the bottom of the tanks 2b. The incoming oil will meet an atmosphere of saturated HC gas, see FIG. 6a, and degassing of oil is prevented/limited. The oil will push the HC gas upwards in the tanks 2b, further into the header 6 via the hatch 10b and valve 12bP when the pressure above the incoming cargo exceeds the preset opening pressure of the valve 12bP. As is evident from FIG. 6a, the saturated HC gas will now flow into the tanks 2a from the header 6 via the open valve 14a and the pipe 7a and further to the bottom of these, and the HC gas will force the inert gas out of the tanks 2a via the hatches 10a and the valves 13a which now are being kept in the open position, and from there on further into the pipe arrangement 8 for inert gas. FIG. 6b illustrates the situation upon completion of the loading of the tank set 2b. The tanks 2a will now be filled with saturated HC gas with a marginal admixture of inert gas, and these tanks will now form the next set of tanks to be loaded. The cargo tanks 2b are in this case loaded up to somewhat below 100%, preferably 98%, of the total loading capacity of the tanks to ensure an expansion volume for the oil during the transportation trip. The loading of these and the remaining tank sets are carried out according to the same method as for the tanks 2b.

At the same time as the last set of tanks 2 are loaded, the saturated HC gas may, if this is wanted, be guided from these tanks via the pipe arrangement 21 to a recovery plant (not shown) for HC gas which is located either on the tanker 1 itself or on-shore. If the plant is located onshore, the saturated HC gas may be temporary stored before it is processed to be recovered. In the opposite case the HC gas has to be processed continuously as it is pushed out of the tank. Economical considerations give as a result that the loading should be carried out as swiftly as possible, and this could impose unreasonable requirements on the capacity of such a recovery plant.

An alternative method for loading of the tanker 1 will in the following be explained in more detail. The purpose of this method is to provide a substantial increase of available processing time for the HC gas located in the tanks after the discharging, since the processing takes place in a recovery plant on the tanker, at the same time as the total discharging period mainly is kept as short as the discharging period in the loading method which was described above.

Referring to the tank picture existing after discharging according to the method for discharging which was first described, as it is illustrated in FIG. 4b, the loading is initiated by loading oil into the S/C tanks 4. The pressure of the HC gas in the S/C tanks 4 will rise, and the valve 12cP opens such that the HC gas flows into the header 6. The valves 18 and 14a are kept in the open position such that the HC gas in the header 6 is guided into the cargo tanks 2a via the pipes 7a. The HC gas flows into the cargo tanks at their bottom, and since the HC gas is substantially heavier than inert gas it will stabilize in the form of a layer at the bottom of the cargo tanks 2a, see FIG. 7a. The next step in the loading is to load the cargo tanks 2a. The oil is guided in the normal way into the tanks 2a at their bottom, and meets an atmosphere of saturated HC gas, see FIG. 7b. When the cargo in the tanks 2a rises, the gases above the cargo are compressed. When the loading is started the concentration of HC gas at the hatch 10a is very low, and the inert gas valves 13a opens at the preset pressure value, preferably +2.5 mwc, and the inert gas is guided into the pipe arrangement 8 for inert gas. When the layer of HC gas is approaching the hatch, see FIG. 7c, the concentration of HC gas increases, and when this concentration exceeds a certain value, the valves 13a will close, and the valves 12aP which so far have been forcibly closed, will open. The HC gas will now be guided into the header 6 and further into the next set of tanks to be loaded (not shown) via valves 14 and pipes 7, see FIG. 7c, wherein the HC gas will stabilize at the bottom of these tanks in the same way as what happened in the tanks 2a. The remaining cargo tanks, except for that set of tanks 2b which after tank cleaning is loaded with saturated HC gas, are subsequently loaded using the same method as was used when loading the tanks 2a.

During the entire period in which loading of those cargo tanks 2 which prior to the loading is not filled with saturated HC gas is carried out, oil is slowly loaded into the cargo tanks 2b and the S/C tanks 4 which prior to the loading is filled with saturated HC gas. The saturated HC gas is thus slowly driven out of the tanks 2b and 4 and further into a possible recovery plant (not shown) via pipe and valves 21. The loading capacity of two of these cargo tanks 2b will for a conventional tanker 1 account for approximately 10% of the total loading capacity of the tanker. The total discharging period is denoted as T, which means that in the first mentioned discharging method, the recovery plant has to process the HC gas during a period T/10, while the same processing period has increased to T in the latter method.

In the description of the latter method for loading the tanker 1, it was assumed that the tank picture was the same as what is found after discharging according to the first described method for discharging, see FIG. 4b, and it should therefore be noted that said loading method may advantageously be used also when the latter described discharging method is used, see FIG. 5b. In this case the loading of those tanks 2 which in advance are filled up with HC gas may be started directly according to the above described method, since there already exists a layer consisting of HC gas at the bottom of these tanks, see FIG. 5b.

According to an alternative embodiment of the loading method, the cargo tanks are loaded approximately 100% in that the oil is loaded all the way up to the uppermost level in the risers 11, see FIG. 8. The S/C tanks 4 may, if necessary, be used as expansion tanks, and will together with the header 6 function as a drain arrangement in those cases in which a possible expansion of the oil in the cargo tanks takes place during the transportation trip, or as an oil reservoir in those cases in which a contraction takes place during the transportation trip. If the volume of the oil in one or several cargo tanks expands on the way, e.g. because of a heating of the oil, the oil will leave the cargo tanks 2 via the valves 12P, and will further be guided via the header 6, valve 14c and the pipe 7c to the S/C tanks 4. If the oil in the cargo tanks 2 goes through a volume reduction on the way, e.g. because of a cooling of the oil, oil is supplied from the S/C tanks 4 by means of the pump 22 via the pipe arrangement 9 and the valves 23 to the cargo tanks 2. From this it will be evident that the loading degree of the S/C tanks 4 may vary from partial loading, for example 50%, to 100% depending on cargo and transportation route.

The main purpose of loading the cargo tanks 2 100% full is to eliminate or strongly reduce the great discharges of oil typically taking place upon damages in the tanker bottom resulting from a possible grounding during the transportation trip. In the following this will be investigated closer by means of an example, in which it is assumed that a grounding resulting in a rupture in the bottom 24 has taken place, and that the rupture extends all the way along the middle section of the tanker 1. The following assumptions are made with respect to the characteristics of the oil and the tanker:

| | |
|---|---|
| Density of load (30° C.): | $\mu_l = 0.900$ tons/m$^3$ |
| Density see water: | $\mu_v = 1.025$ tons/m$^3$ |
| True Vapor Pressure (30° C.): | $p_{tv} = 4.8$ mwc |
| Diameter of riser 11: | $d_s = 0.2$ m |
| Height of riser 11 above deck: | $h_s = 1.5$ m |
| Height 30 of cargo tank 2: | $h_L = 17.8$ m |
| Width 30 of centre cargo tank 2: | $b = 16.4$ m |
| Length 5 of the cargo section: | $l = 143$ m |
| Draft 28: | $h_D = 12.9$ m |
| Atmospheric pressure: | $p_{atm} = 10.3$ mwc |
| The valves 12V open at: | $p_{12V} = p_{atm} - 4.50$ mwc |

If the cargo tanks are loaded according to known methods, i.e. with a loading degree of 0.98, the oil level 29 in cargo tanks 2 $h_{0.98}$ will be $$h_{0.98}=0.98*h_L=17.44 \quad (L.1)$$

and the hydrostatic pressure difference prior to the grounding, given that the oil is the same as in the first example, will consequently be given as $$p_{diff}=(p_{atm}+p_n+\mu_1*h_{0.98})-(p_{atm}+\mu_v*h_D) \quad (L.2)$$

$$p_{diff}=2.97 \text{ mwc} \quad (L.3)$$

where $p_n+0.5$ mwc is the required overpressure in the inert gas above the cargo surface to ensure that air does not flow in and mix with the inert gas.

According to the conventional method for transportation of oil, the pressure/vacuum valves at the top of the hatch are tuned to open at an underpressure of 0.7 mwc compared to the atmospheric pressure. The following conditions therefore have to be fulfilled to establish a hydrostatic pressure balance at the bottom 24 of the tanker:

$$P_{inside}=P_{outside} \quad (L.4)$$

$$-0.7\ mwc+h_{Ln}*0.9=12.9*1.025 \quad (L.5)$$

$$h_{Ln}=15.47 \quad (L.6)$$

The reduction $h_r$ in the loading level will after this have to be $$h_r=h_{0.98}-h_{Ln}=17.44-15.47=1.97\ m. \quad (L.7)$$

Total amount of discharged oil $M_{out}$:

$$M_{out}=b*1*h_r*\mu_1 4158\ tons \quad (L.8)$$

The real amount of discharged oil will be far greater than what is calculated above, since these calculations do not take into account the reduction of the draft of the tanker when oil starts to leak into the sea. Calculations show that when this is taken into account, the discharges amount to approximately 7300 tons.

The reductions may be strongly reduced by means of the initially mentioned underpressure method in which the valves 12V are preset to open at a substantially higher underpressure. This preset pressure value will however be limited by the maximum pressure loads which the tanker is dimensioned to withstand, and typically this value is 2.5 mwc. Calculations show that also in this case a substantial amount of oil will be discharged; taking into account the draft reduction the discharges amounts to approximately 411 tons.

It is now assumed that the cargo tanks are loaded with oil all the way up to the valves 12P, 12V, and consequently the volume of the ullage space is approximately zero. It is further assumed that the gas in the ullage space behaves approximately like an ideal gas, which means that the following relation is valid upon a pressure change:

$$p_0V_0=p_1V_1 \quad (L.9)$$

where p and V refers to the pressure in- and the volume of the ullage space, respectively, and the indices 0 and 1 refer to the states before and after the pressure change, respectively.

Before the grounding takes place, the pressure above the cargo is approximately equal to the atmospheric pressure. At the bottom 24 of the tankers 2 the hydrostatic pressure difference $p_{diff}$ will be as follows:

$$P_{diff}=P_{inside}-P_{outside} \quad (L.10)$$

$$p_{diff}=(P_{atm}+\mu_1*(h_L+h_s))-(p_{atm}+\mu_v*h_D) \quad (L.11)$$

$$p_{diff}=4.15\ mwc \quad (L.12)$$

This means that the pressure above the cargo in the riser 11 has to decrease by 4.15 mwc to have the hydrostatic balance established at the bottom 24 of the cargo tanks 2. When the tanker 1 runs aground, a sudden pressure change is registered and the valve 12V is closed immediately. There will now exist a closed volume above the cargo in the riser 11, the volume $V_{O\ of\ which}$ is assumed to be approximately zero, and the abovementioned pressure difference takes place with an associated volume expansion which is practically neglectible, and consequently the amount of oil discharge from the cargo tanks 2 will be correspondingly neglectible. This follows from equation (L.9) which reformulated gives:

$$V_1=(p_0/p_1)*V_0 \quad (L.13)$$

$$V_1=(10.3\ mwc/(10.3\ mwc-4.15\ mwc))*V_0 \quad (L.14)$$

$$V_1=1.67\ *V_0 \quad (L.15)$$

From equation (L.15) it will be seen that the volume $V_1$ above the oil after the hydrostatic balance is established also will be approximately zero.

The pressure above the cargo at the valves 12P, 12V will now be $$p_1=p_{atm}-p_{diff} \quad (L.16)$$

$$p_1=10.3\ mwc-4.15\ mwc=6.15\ mwc \quad (L.17)$$

The pressure at the deck of the tanker will be $$p_{td}=p_1+\mu_1*h_s \quad (L.18)$$

$$p_{td}=6.15\ mwc+0.9\ tons/m^3*1.5\ m=7.5\ mwc \quad (L.19)$$

From this one can see that the pressure of the oil in those areas where the oil possibly may start to de-gas, i.e. at the valves 12P, 12V and underneath the deck 25 of the tanker, the pressure is far above the true vapor pressure, and consequently there will be no further de-gassing, with an associated increase of pressure, from the cargo surface. The true vapor pressure of the oil increases when the density of the oil decreases. Another embodiment of the invention illustrate how this is taken care of in the invention:

| | |
|---|---|
| Cargo density: | $\mu_l$ = 0.860 tons/m$^3$ |
| True Vapor Pressure: | $p_{tv}$ = 7.9 mwc |

By using the same method as above one will find that:

$$p_{diff}=3.34 \text{ mwc}$$

$$p_1=6.96 \text{ mwc}$$

$$p_{td}=8.25 \text{ mwc}$$

From this one will see that the pressure at the valves 12P, 12V is below true vapor pressure, and the oil will start to de-gas at the top of the riser 11. This de-gassing will continue until the saturation pressure Pry is reached, and some oil will be pushed out. According to the invention the valves will in this case be tuned such that they open for incoming gas at the saturation pressure Pry of the oil, i.e. at 7.9 mwc, and de-gassing is prevented. This means, however, that the pressure $P_1$ above the cargo does not fall sufficiently for establishing hydrostatic equilibrium, and a smaller amount of oil will have to escape in order to compensate for this pressure increase above the oil. The reduction $h_r$ in the riser 11 is calculated as follows:

$$h_r * \mu l = p_{tv} - p_1$$

$$h_r = (p_{tv} - p_1)/\mu_1$$

$$h_r = (7.9\ mwc - 6.96\ mwc)/0.86\ tons/m^3 = 1.09\ m.$$

The reduction in the cargo level is therefore much smaller than the total heights of the tank hatch 10 and riser 11, and the amount of the release will therefore be negligible.

An important prerequisite for the amount of the oil spill to be as low as calculated above, is the assumption that the gas volume above the oil at the time of grounding and the following pressure decrease is approximately equal to zero. It is describes above how the oil in the S/C tanks 4 may be used for topping up the cargo tanks 2 by reducing the load level. It is therefore reasonable to assume that the cargo tanks are filled all the way up to the valves 12P, 12V when the tanker 1 runs aground. Furthermore, a grounding will press the bottom 24 inwards and, consequently, the oil will be pressed further upwards. When the pressure fall appears, the oil will therefore lie close to its bounding surfaces at the valve 12P, 12V and tank deck 25. Any gas pockets between the oil and tank deck can be forced out through the pipe 26 and valve 27 to the header 6, see FIG. 2.

It will be understood that the principle of maintaining a cargo level which reaches into the riser 11 during the transport journey also can be used in those circumstances where the tanker 1 has been loaded in accordance with prior art techniques.

FIGS. 9*a* and 9*b* show parts of an alternative embodiment of the pipe and valve system in two different sections. The cargo tank 2 is in a known manner divided into two parts by means of a 'tween-deck 34 and the communication between the upper and lower part of the cargo tank 2 occurs through valves 33 which may be constrained either to open or closed position. During loading the valve 23 must be open, while during the transport journey they are closed. The pipe and valve system according to the invention is adapted to this type of tank arrangement in that each cargo tank has two risers 11 with appurtenant valves 12P, 12V. One of the risers will extend from the tank hatch 10 and into the header 6, while the other riser 11 extends from the lower part of the tank 2 and into the,header 6.

It will be understood that the method for loading according to the invention may be performed simply also for a cargo tank arrangement as shown in FIGS. 9*a* and 9*b*. By letting the valves 30 remain in open position until the oil has reached the specific degree of filling in the upper and lower tank, e.g. 98% or all the way up to the valves 12P, 12V at the top of the riser 11, the method for loading will generally be identical to that described above.

In a cargo tank arrangement as illustrated in FIGS. 9*a* and 9*b* the 'tween-deck 34 is arranged so that the external pressure against the bottom 24 is higher than the internal pressure from the oil in the lower cargo tank 2. The purpose is that upon grounding, the external sea water will force the oil upwards in the tank 2 instead of an oil spill taking place. If one loads the lower tank 2 to a degree of filling of less than 100%, the 'ween-deck will have to support the weight of the cargo in the upper tank 2, thus loading the 'tween-deck 34 considerably, particularly in the forward and aft cargo tanks. In heavy seas, the acceleration and retardation forces will be particularly straining. At a degree of filling of about 100% one accomplishes to hydrostatically balance the strain on the two sides of the 'tween-deck 34 and the strain will be almost eliminated.

If either cracks occur in the 'tween-deck 34 or one or more of the valves 33 are either defective or inadvertently left open, the oil spill would still be eliminated or strongly reduced as previously described if, in accordance with the invention, the oil is loaded into the risers 11 up towards the valves 12P, 12V. In this way, loading to a degree of filling of about 100% acts as an extra safety precaution against oil spills in grounding situations.

The underpressure effect above the cargo described above will also act positively in any collision producing a hole in the side of the ship. The instantaneous underpressure above the cargo will reduce the discharge velocity and quantity.

I claim:

1. A method of unloading a tanker (1) for transporting oil, said tanker (1) comprising cargo tanks (2) and slop/cargo (S/C) tanks (4), said task (2, 4) each comprising a tank hatch (10) with a riser pipe (11) and pressure/vacuum valves (12P, 12V) at the top of the task (2, 4), said tanker (1) further comprising a first pipe system (8) for inert gas communicating with the tanks (2, 4) through valves (13), and a second pipe system (9), wherein the oil prior to unloading is present in one or more of the tanks (2, 4) and during unloading leaves one or more tanks (2, 4) at a time at the bottom (24) thereof, characterized in that the unloading of a first tank is performed concurrently with an atmosphere generally constituted by saturated hydrocarbon containing gas being maintained in the tank, whereupon a second tank (2*b*) is unloaded concurrently with said saturated hydrocarbon containing gas being conveyed from said first tank (2*a*) in above the oil in said second tank.

2. A method according to claim 1, characterized in that concurrently with the unloading of said second tank (2*b*), a second gas is conveyed in above said hydrocarbon containing gas in said first tank (2*a*), said second gas preferably being lighter than said hydrocarbon containing gas.

3. A method according to claim 2, characterized in that said second gas is an inert gass.

4. A method according to claim 1, characterized in that further tanks (2) are unloaded in the same manner as said second tank.

5. A method for unloading a tanker (1) for transporting oil, said tanker (1) comprising cargo tanks (2) and slop/cargo (S/C) tanks (4), said tanks (2, 4) comprising a tank hatch (10) with a riser pipe (11) and pressure/-vacuum valves (12P, 12V) at the top of the tanks (2, 4), said tanker (1) further comprising a first pipe system (8)

for inert gas communicating with the tanks (2, 4) through valves (13), and a second pipe system (9), wherein the oil prior to unloading is present in one or more of the tanks (2, 4) and during unloading concurrently leaves a set consisting of one or more tanks (2, 4) at a time at the bottom (24) thereof, characterized in that the unloading of at least one set of tanks (2, 4) wholly or in part is performed concurrently with the surface of the oil in this set of tanks being kept in contact with an atmosphere generally constituted by saturated hydrocarbon containing gas, and further characterized in that during unloading of said set of tanks, a second gas is conveyed in above said saturated hydrocarbon containing gas, said second gas being lighter than the hydrocarbon containing gas.

6. A method according to claim 5, characterized in that said second gas is an inert gas.

7. A method of loading a tanker (1) for transporting oil, said tanker (1) comprising cargo tanks (2) and slop/-cargo (S/C) tanks (4), the tanks (2, 4) each comprising a tank hatch (10) having a riser (11) and pressure/-vacuum valves (12P, 12V) at the top of the tanks (2, 4), said tanker (1) further comprising a first pipe system (8) for inert gas communicating with the tanks (2, 4) through valves (13), and a second pipe system (9), the oil during loading being conveyed into said cargo tanks (2) at the bottom (24) thereof, characterized in that loading of a first tank (2*b*) is performed concurrently with the surface of the oil in said tank being kept in contact with an atmosphere constituted generally by saturated hydrocarbon containing gas, the saturated hydrocarbon containing gas displaced from the tank being transferred to the bottom of a second tank (2*a*) subsequently to be loaded.

8. A method according to claim 7, characterized in that while a first one of said tanks (2*b*) is loaded with oil, when the concentration of hydrocarbons in the gas at the top of said first tank lies below a predetermined value, the gas is conveyed out of the first tank (2*b*) and into the pipe system (8) for inert gas, and when said concentration exceeds a predetermined value, the gas is conveyed into a second tank (2*a*).

9. A method according to claim 8, characterized in that said first tank (2*b*) prior to loading has a larger concentration of hydrocarbon containing gas than said second tank (2*a*).

10. A method to claim 8 characterized in that during loading of said cargo tanks (2), the cargo tanks (2) are kept closed until the pressure in the cargo tanks exceeds a predetermined value.

11. A method according to claim 7, characterized in that loading is performed concurrently in two tanks, one of the tanks being loaded more slowly than the other while the gas displaced from the tank is sent to a hydrocarbon recovery plant.

12. A method according to claim 11, characterized in that said tank being loaded more slowly has a higher concentration of hydrocarbon containing gas than the other.

13. A method according to claim 7, characterized in that the tanks (2) are filled up to and into the risers (11), preferably all the way up to the pressure/vacuum valves (12P, 12V).

14. A method according to claim 7, characterized in that the amount of oil in the cargo tanks (2) during transport is controlled so that the oil cargo extends into the risers (11) and preferably all the way up to the pressure/vacuum valves (12P, 12V).

15. A pipe and valve system for a tanker (1) for transporting oil, said tanker (1) comprising cargo tanks (2) and slop/cargo (S/C) tanks (4), said tanks (2, 4) each comprising a tank bottom (24), a tank deck (25) and a tank hatch (10) with a riser (11) and pressure/vacuum valves (12P, 12V) at the top of the tanks (2, 3, 4), said tanker (1) further comprising a first pipe system (8) for inert gas communicating with the tanks (2, 4) through valves (13), and a second pipe system, characterized in that additionally a header (6) is arranged which through pipes (7) communicates with the tanks (2, 4), valves (14) being arranged in the pipes (7), in that the risers (11) with valves (12P, 12V) extend into the header (6), and in that, in addition, valves (15) are arranged for regulating a connection between the header (6) and the pipe system (8) for inert gas.

16. A pipe and valve system according to claim 15, characterized in that at the top of at least one of the tanks (2, 4) a detector is arranged for measuring the concentration of hydrocarbons in any gas contained in said at least one tank.

17. A pipe and valve system according to claim 15, characterized in that the valve (13) for communicating said first pipe system (8) with said tanks (2, 4) are controlled by the pressure in the tanks (2, 4) and the concentration of hydrocarbon containing gases in the tanks (2, 4).

18. A pipe and valve system according to claim 17, characterized in that the pressure/ vacuum valves (12P, 12V) are controlled by the pressure in the tanks (2, 4) and the position of the inert gas valves (13).

19. A pipe and valve system according to claim 15, characterized in that further pipes (26) are arranged interconnecting the header (6) and tanks (2, 4) through further valves (27).

20. A pipe and valve system according to claim 15, characterized in that for one or more tanks (2, 4) a further riser (11) with valves (12P, 12V) is arranged, said further riser extending into the header (6) and extending down into the tanks (2, 4) at a point different from the tank hatch (10).

* * * * *

UNITED STATES PATENT AND TRADEMARK OFFICE

CERTIFICATE OF CORRECTION

PATENT NO. : 5,398,629

DATED : March 21, 1995

INVENTOR(S) : REIDAR WASENIUS

It is certified that error appears in the above-identified patent and that said Letters Patent is hereby corrected as shown below:

Claim 1, col. 12, line 36, delete "task" and substitute therefor -- tanks --; Claim 1, col. 12, line 38, delete "task" and substitute therefor -- tanks --; Claim 10, col. 13, line 47, after "method" insert -- according --; Claim 17, col. 14, line 36, delete "valve" and substitute therefor -- valves --.

Signed and Sealed this

Eleventh Day of July, 1995

*Attest:*

Bruce Lehman

BRUCE LEHMAN

*Attesting Officer*

*Commissioner of Patents and Trademarks*